US007837012B2

(12) United States Patent
Sakai et al.

(10) Patent No.: US 7,837,012 B2
(45) Date of Patent: Nov. 23, 2010

(54) CONTROL DEVICE FOR ELEVATOR

(75) Inventors: Masaya Sakai, Tokyo (JP); Takaharu Ueda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 717 days.

(21) Appl. No.: 10/573,651

(22) PCT Filed: Sep. 29, 2003

(86) PCT No.: PCT/JP03/12417

§ 371 (c)(1),
(2), (4) Date: Mar. 28, 2006

(87) PCT Pub. No.: WO2005/030627

PCT Pub. Date: Apr. 7, 2005

(65) Prior Publication Data

US 2007/0012521 A1 Jan. 18, 2007

(51) Int. Cl.
*B66B 1/16* (2006.01)

(52) U.S. Cl. ..... 187/380; 187/293; 187/296; 187/391; 187/395

(58) Field of Classification Search ..... 187/293, 187/395, 296, 380, 391
See application file for complete search history.

(56) References Cited

U.S. PATENT DOCUMENTS 3,037,201 A * 5/1962 Kelley ..... 340/870.06
4,567,419 A * 1/1986 Watanabe ..... 318/798
4,629,035 A * 12/1986 Tanahashi et al. ..... 187/296
4,658,935 A * 4/1987 Holland ..... 187/293
6,164,416 A * 12/2000 Laine et al. ..... 187/284
2001/0045326 A1* 11/2001 Gottlieb et al. ..... 187/254

FOREIGN PATENT DOCUMENTS

| | | |
|---|---|---|
| JP | 7-163191 | 6/1995 |
| JP | 9-110329 | 4/1997 |
| JP | 9-267977 | 10/1997 |
| JP | 11-53005 | 2/1999 |
| JP | 2002-3091 | 1/2002 |
| JP | 2003-238037 | 8/2003 |
| KR | 10-2006-0072149 | 6/2006 |

OTHER PUBLICATIONS

Machine translation of JP2002-003091.*
U.S. Appl. No. 11/794,823, filed Jul. 6, 2007, Ueda, et al.

* cited by examiner

*Primary Examiner*—Walter Benson
*Assistant Examiner*—Kawing Chan
(74) *Attorney, Agent, or Firm*—Oblon, Spivak, McClelland, Maier & Neustadt, L.L.P.

(57) ABSTRACT

The present invention provides an elevator controller including: a main control unit for controlling running of an elevator, in which the main control unit predictively calculates a continuous temperature state of a predetermined componential equipment of the elevator and performs an operation control of the elevator based on the predicted temperature state such that the componential equipment is not overloaded. Accordingly, a temperature rise in the componential equipment is suppressed, thereby enabling to prevent the elevator from becoming inoperable.

14 Claims, 10 Drawing Sheets

FIG. 4

10

MOVING DISTANCE $L_1$

| | $(\alpha_{1_1}, \beta_{1_1}, v_{1_1})$ | $(\alpha_{2_1}, \beta_{2_1}, v_{2_1})$ | ··· | $(\alpha_{M_1}, \beta_{M_1}, v_{M_1})$ |
|---|---|---|---|---|
| $H_1$ | $(W_{11_1}, U_{11_1})$ | $(W_{12_1}, U_{12_1})$ | ··· | $(W_{1M_1}, U_{1M_1})$ |
| $H_2$ | $(W_{21_1}, U_{21_1})$ | $(W_{22_1}, U_{22_1})$ | ··· | $(W_{2M_1}, U_{2M_1})$ |
| ··· | ··· | ··· | ··· | ··· |
| $H_N$ | $(W_{N1_1}, U_{N1_1})$ | $(W_{N2_1}, U_{N2_1})$ | ··· | $(W_{NM_1}, U_{NM_1})$ |

MOVING DISTANCE $L_2$

| | $(\alpha_{1_2}, \beta_{1_2}, v_{1_2})$ | $(\alpha_{2_2}, \beta_{2_2}, v_{2_2})$ | ··· | $(\alpha_{M_2}, \beta_{M_2}, v_{M_2})$ |
|---|---|---|---|---|
| $H_1$ | $(W_{11_2}, U_{11_2})$ | $(W_{11_2}, U_{12_2})$ | ··· | $(W_{1M_2}, U_{1M_2})$ |
| $H_2$ | $(W_{21_2}, U_{21_2})$ | $(W_{22_2}, U_{22_2})$ | ··· | $(W_{2M_2}, U_{2M_2})$ |
| ··· | ··· | ··· | ··· | ··· |
| $H_N$ | $(W_{N1_2}, U_{N1_2})$ | $(W_{N2_2}, U_{N2_2})$ | ··· | $(W_{NM_2}, U_{NM_2})$ |

≈

MOVING DISTANCE $L_p$

| | $(\alpha_{1_p}, \beta_{1_p}, v_{1_p})$ | $(\alpha_{2_p}, \beta_{2_p}, v_{2_p})$ | ··· | $(\alpha_{M_p}, \beta_{M_p}, v_{M_p})$ |
|---|---|---|---|---|
| $H_1$ | $(W_{11_p}, U_{11_p})$ | $(W_{12_p}, U_{12_p})$ | ··· | $(W_{1M_p}, U_{1M_p})$ |
| $H_2$ | $(W_{21_p}, U_{21_p})$ | $(W_{22_p}, U_{22_p})$ | ··· | $(W_{2M_p}, U_{2M_p})$ |
| ··· | ··· | ··· | ··· | ··· |
| $H_N$ | $(W_{N1_p}, U_{N1_p})$ | $(W_{N2_p}, U_{N2_p})$ | ··· | $(W_{NM_p}, U_{NM_p})$ |

FIG. 7

20

RUNNING MODE 1

| | $L_1$ | $L_2$ | ··· | $L_p$ |
|---|---|---|---|---|
| $H_1$ | ($\alpha_{11_1}$, $\beta_{11_1}$, $V_{11_1}$) | ($\alpha_{12_1}$, $\beta_{12_1}$, $V_{12_1}$) | ··· | ($\alpha_{1p_1}$, $\beta_{1p_1}$, $V_{1p_1}$) |
| $H_2$ | ($\alpha_{21_1}$, $\beta_{21_1}$, $V_{21_1}$) | ($\alpha_{22_1}$, $\beta_{22_1}$, $V_{22_1}$) | ··· | ($\alpha_{2p_1}$, $\beta_{2p_1}$, $V_{2p_1}$) |
| ··· | ··· | ··· | ··· | ··· |
| $H_N$ | ($\alpha_{1N_1}$, $\beta_{1N_1}$, $V_{1N_1}$) | ($\alpha_{2N_1}$, $\beta_{2N_1}$, $V_{2N_1}$) | ··· | ($\alpha_{Np_1}$, $\beta_{Np_1}$, $V_{Np_1}$) |

RUNNING MODE 2

| | $L_1$ | $L_2$ | ··· | $L_p$ |
|---|---|---|---|---|
| $H_1$ | ($\alpha_{11_2}$, $\beta_{11_2}$, $V_{11_2}$) | ($\alpha_{12_2}$, $\beta_{12_2}$, $V_{12_2}$) | ··· | ($\alpha_{1p_2}$, $\beta_{1p_2}$, $V_{1p_2}$) |
| $H_2$ | ($\alpha_{21_2}$, $\beta_{21_2}$, $V_{21_2}$) | ($\alpha_{22_2}$, $\beta_{22_2}$, $V_{22_2}$) | ··· | ($\alpha_{2p_2}$, $\beta_{2p_2}$, $V_{2p_2}$) |
| ··· | ··· | ··· | ··· | ··· |
| $H_N$ | ($\alpha_{1N_2}$, $\beta_{1N_2}$, $V_{1N_2}$) | ($\alpha_{2N_2}$, $\beta_{2N_2}$, $V_{2N_2}$) | ··· | ($\alpha_{Np_2}$, $\beta_{Np_2}$, $V_{Np_2}$) |

≈

RUNNING MODE q

| | $L_1$ | $L_2$ | ··· | $L_p$ |
|---|---|---|---|---|
| $H_1$ | ($\alpha_{11_q}$, $\beta_{11_q}$, $V_{11_q}$) | ($\alpha_{12_q}$, $\beta_{12_q}$, $V_{12_q}$) | ··· | ($\alpha_{1p_q}$, $\beta_{1p_q}$, $V_{1p_q}$) |
| $H_2$ | ($\alpha_{21_q}$, $\beta_{21_q}$, $V_{21_q}$) | ($\alpha_{22_q}$, $\beta_{22_q}$, $V_{22_q}$) | ··· | ($\alpha_{2p_q}$, $\beta_{2p_q}$, $V_{2p_q}$) |
| ··· | ··· | ··· | ··· | ··· |
| $H_N$ | ($\alpha_{1N_q}$, $\beta_{1N_q}$, $V_{1N_q}$) | ($\alpha_{2N_q}$, $\beta_{2N_q}$, $V_{2N_q}$) | ··· | ($\alpha_{Np_q}$, $\beta_{Np_q}$, $V_{Np_q}$) |

FIG. 8

30

| | RUNNING MODE 1 | RUNNING MODE 2 | ··· | RUNNING MODE q |
|---|---|---|---|---|
| P1 | $(w_{11}, Q_{11})$ | $(w_{12}, Q_{12})$ | ··· | $(w_{1q}, Q_{1q})$ |
| P2 | $(w_{21}, Q_{21})$ | $(w_{22}, Q_{22})$ | ··· | $(w_{2q}, Q_{2q})$ |
| ··· | ··· | ··· | ··· | ··· |
| Pn | $(w_{n1}, Q_{n1})$ | $(w_{n2}, Q_{n2})$ | ··· | $(w_{nq}, Q_{nq})$ |

CONTROL DEVICE FOR ELEVATOR

TECHNICAL FIELD

The present invention relates to an elevator controller, and more particularly, to an elevator controller that prevents an equipment from being thermally overloaded.

BACKGROUND ART

As regards a controller that adjusts acceleration or deceleration or maximum speed by changing a speed pattern or the like assigned to a motor used in an elevating machine or the like, depending on load or moving distance, there have been developed controllers for preventing an equipment from being thermally overloaded.

An art concerning a conventional elevator controller of this kind is disclosed in, for example, JP 2002-3091 A. This controller includes a main control unit for performing an operation control of the elevator, a power drive unit for driving a motor, and a thermal sensing device installed for an equipment that is getting hot when the elevator is being operated. The main control unit suppresses temperature rise of the equipment by performing a load suppressing operation on the basis of temperature detection results of the thermal sensing device before the equipment becomes inoperable due to overheating, thus preventing the equipment from becoming inoperable. In this conventional art, a determination on a load state of the equipment is made through a comparison between a temperature detection result or its rate of change and a critical temperature of the equipment, and a changeover to the load suppressing operation is made, so that the equipment is prevented from becoming inoperable.

Further, a conventional controller that adjusts acceleration or deceleration and maximum speed of a motor depending on load is disclosed in, for example, JP 7-163191 A. An elevator controller that adjusts acceleration or deceleration by changing a speed pattern or the like assigned to a motor depending on load and a moving distance is disclosed in JP 9-267977 A.

In the aforementioned conventional apparatuses, a temperature rise of the equipment is suppressed by making a changeover to the load suppressing operation before the equipment reaches a drive-permitting critical temperature, to thereby prevent deterioration in running efficiency resulting from inoperability of the equipment. However, since a timing at which the changeover to the load suppressing operation takes place is determined based on an output result of the thermal sensing device or its temporal rate of change, a total amount of the temperature rise in the end cannot be estimated with accuracy. Therefore, the changeover timing to the load suppressing operation is not always appropriate, which results in a problem in that running efficiency is deteriorated.

DISCLOSURE OF THE INVENTION

The present invention has been made as a solution to the above-mentioned problem, and it is an object of the present invention to provide an elevator controller that allows an elevator to be operated at a high running efficiency without exceeding a drive-permitting temperature limit by performing a suitable changeover in speed pattern or running pattern of the elevator, which is attained by more accurately estimating a future temperature state of an equipment through a predictive calculation of a continuous temperature state of the equipment.

The present invention provides an elevator controller including: a main control unit for controlling running of an elevator, in which the main control unit predictively calculates a continuous temperature state of a predetermined componential equipment of the elevator and performs an operation control of the elevator based on the predicted temperature state such that the componential equipment does not become overloaded.

According to the present invention, the elevator controller further includes: a thermal sensing device that detects a temperature of the predetermined componential equipment; and change amount input means for inputting a predetermined change amount (a drive input amount or temperature rise amount) concerning the predetermined componential equipment, in which the main control unit calculates a predicted value of a continuous temperature state of the componential equipment using the temperature detected by the thermal sensing device and the change amount inputted by the change amount input means.

According to the present invention, it is possible to run the elevator at a high running efficiency without exceeding a drive-permitting temperature limit by performing suitable changeover in speed pattern or running pattern of the elevator, which is attained by more accurately estimating a future temperature state of the predetermined componential equipment of the elevator through a predictive calculation of a continuous temperature state of the equipment.

BRIEF DESCRIPTION OF THE DRAWINGS

FIG. 4 is an explanatory diagram showing an example of a data table in the elevator controller according to the embodiment 2 of the present invention.

FIG. 7 is an explanatory diagram showing an example of a data table in the elevator controller according to the embodiment 3 of the present invention.

FIG. 8 is an explanatory diagram showing an example of another data table in the elevator controller according to the embodiment 3 of the present invention.

BEST MODES FOR CARRYING OUT THE INVENTION

Embodiment 1

Figure 1:
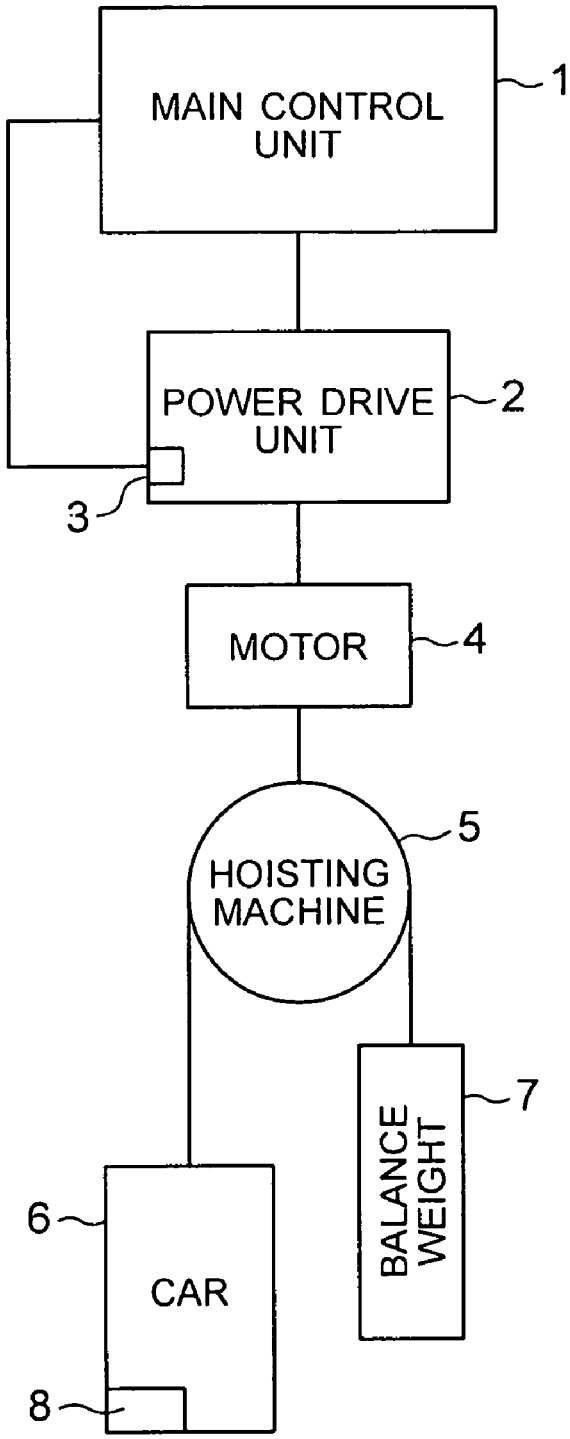
FIG. 1 is a block diagram showing a construction of an elevator controller according to embodiments 1 to 3 of the present invention.

Hereinafter, a construction of an embodiment of the present invention will be described with reference to FIG. 1. FIG. 1 is a block diagram showing an overall construction of an elevator controller according to the embodiment 1 of the present invention and an elevator system as a control target. In the drawing, a main control unit 1 controls the running of the elevator and is functionally different from the aforementioned conventional apparatuses. A power drive unit 2, which is constructed of an inverter or the like for example, receives a command from the main control unit 1 and drives a motor. The motor 4 raises or lowers a car 6 and a balance weight 7, which are coupled to each other via a rope by rotating a hoisting machine 5. A thermal sensing device 3 is installed in the power drive unit 2 to detect a temperature state thereof. A scale 8 is installed in the car 6 to detect a load within the car. The power drive unit 2, the thermal sensing device 3, the motor 4, the hoisting machine 5, the car 6, the balance weight 7, and the scale 8 are identical with those of the conventional apparatuses. Other equipments whose temperature-rise should be monitored by the thermal sensing device 3 further include a motor or an inverter element. In this embodiment, the power drive unit 2 is taken as an example in describing this embodiment.

The operation of this embodiment will now be described.

The main control unit 1 receives an output from the thermal sensing device 3, calculates a temperature state of the equipment according to a preset temperature model, and controls the running of the elevator so that the temperature of the equipment should not become excessively high. Examples of an operation control method include a method of lowering a temperature of the equipment through an operation of a cooling unit such as a radiation fan or a heat pipe, and a method of performing a load suppressing operation by changing speed, acceleration or deceleration, or jerk (rate of change in acceleration or deceleration) of the car. If the thermal sensing device 3 is not installed, a suitable initial temperature state is set instead of an output of the thermal sensing device 3. For instance, an average temperature on a typical day or an average temperature in each time zone in a region where the elevator is placed may be set as an initial temperature. Furthermore, if an amount of change in temperature state only matters, it is sufficient to calculate merely a temperature rise amount, and there is no need to set an initial temperature.

The operation procedure of this embodiment will now be described with reference to FIG. 2.

First, in a step ST21, a call for the car from a passenger is registered, and a destination floor is registered. At this moment, an imbalance amount (car load) is calculated by the scale 8 installed in the car 6, and a moving distance of the car 6 from a floor at which the car 6 is currently stopped to the destination floor at which the car 6 is to stop subsequently is calculated.

Then in a step ST22, an initial maximum speed value, an initial acceleration or deceleration value, and an initial jerk value, which are required in setting a speed pattern of the car 6 or the motor 4 for driving the car 6, are set. An acceleration or deceleration, a maximum speed, and a jerk can be set in a combined manner to constitute a plurality of sets, and their initial values are selected from the plurality of sets. An initial value may be set to a value set at the time of the last drive, designated as a maximum value among settable values, set to an intermediate value among settable values, etc. The initial value is appropriately set according to a judgment made by a manufacturer or a user, a condition for use, an environment for use, or the like.

In a step ST23, a temperature $T_0$ of the power drive unit 2 is detected by the thermal sensing device 3 and inputted to the main control unit 1. If the thermal sensing device 3 is not required as described above, this step ST23 is omitted or an appropriate initial value is set.

In a step ST24, a predicted value of a post-drive future temperature of the equipment (a continuous temperature state) is calculated according to a predetermined temperature model. This temperature model and a temperature calculation method using it will be described next.

First of all, the temperature model in the step ST24 will be described.

In this embodiment, the temperature model will be described as to a case where it is expressed as a function of a temperature $T_0$ of the equipment detected in the step ST23 and a drive input amount for driving the equipment. However, the temperature model is not limited to that case and can also be expressed as, for example, a function of the number of starts per unit time, the number of passengers. As examples of a model form, there are a first-order lag system model and a second-order lag system model, which are expressed as transfer function models. When the temperature model is expressed in a first-order lag system as an example, it is expressed by the following equation 1. This example will be described as follows. The equipment handled in this embodiment is an inverter, and its drive input amount is a current.

Equation 1:

$$T(s) = \frac{a_0}{(1+\tau_1 s)} i(s) + (T_0 - T_b)$$

In the above equation, s represents a Laplace operator. The above equation is a Laplace transform of the temperature model. T(s) represents a predicted temperature of the equipment, and i(s) represents an absolute value of a current flowing through the inverter. Further, $\tau_1$ represents a time constant. Herein, $T_b$ represents a calculated temperature value calculated at the time of the last drive, and a calculation method thereof will be described later.

A transfer function as expressed by the following equation 2 may also be set as a temperature model. The equation 2 is larger in calculation amount but higher in approximation accuracy than the equation 1. The equation 2 is a model with a cubic denominator and a quadric numerator. However, the respective orders can be arbitrarily set under the constraint that the order of the denominator is equal to or larger than the order of the numerator.

Equation 2:

$$T(s) = \frac{a_0(1+\tau_4 s)(1+\tau_5 s)}{(1+\tau_1 s)(1+\tau_2 s)(1+\tau_3 s)} i(s) + (T_0 - T_b)$$

These time constants or parameter values $a_0, \tau_1, \ldots, \tau_5$ can be set by measuring a current value and a temperature rise amount in advance at the time when the elevator is being driven under a certain load condition and subjecting those values to an experimental method such as least square approximation or the like.

Being expressed by time segments, the equation 1 can be expressed as the following differential equation.

Equation 3:

$$\begin{cases} \dot{x}(t) = -1/\tau_1 x(t) + i(t) \\ T(t) = a_0/\tau_1 x(t) + (T_0 - T_b) \end{cases}$$

It should be noted herein that x(t) represents an intermediate variable. It is well known that a transfer function such as the equation 1 or 2 can be generally expressed by time segments as a differential equation such as the aforementioned equation 3. A solution of the equation 3 is expressed as the following equation 4. Solutions of other transfer functions are also expressed in a similar manner.

Equation 4:

$$T(t) = a_0/\tau_1 e^{-1/\tau_1 t} x(0) + \int_0^t a_0/\tau_1 e^{-1/\tau_1 (t-\tau)} i(\tau) d\tau + (T_0 - T_b)$$

Figure 3:
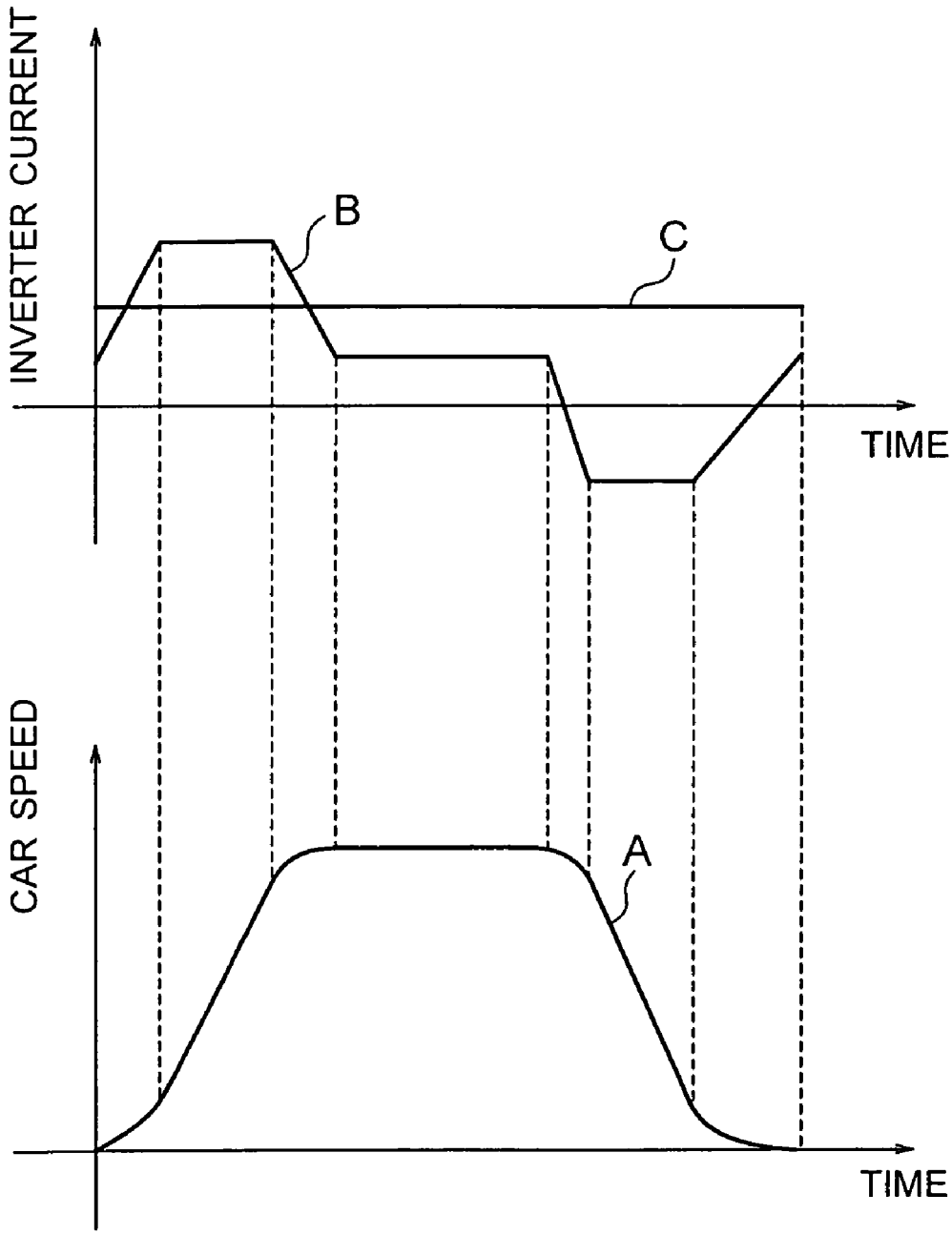
FIG. 3 is an explanatory diagram showing a relationship between a speed pattern and an inverter current value in a common elevator as a control target of the present invention.

Normally, a speed pattern in the case where the elevator moves upwards and downwards once is indicated by A in FIG. 3, and an inverter current pattern in that case is indicated by B in FIG. 3. However, an input function is simplified (see the equation 4) by approximating i(t) as a steady-value function, as indicated by C in FIG. 3 which represents a time average of the magnitude of the current flowing through the inverter. Therefore, a temperature of the inverter can be more easily calculated from the temperature model, and this calculation can be carried out by a more inexpensive calculator. The temperature model in the step ST24 has been described hitherto.

The method of calculating a post-drive temperature of the equipment in the step ST24 will now be described.

First of all, a speed pattern is calculated from the initial maximum speed value, the initial acceleration or deceleration value, and the initial jerk value of the car 6 set in the step ST22. Then, a torque pattern required in driving the hoisting machine by means of the motor according to the speed pattern can be calculated from the imbalance amount and a mechanical model of the elevator. Then, an inverter current value required in driving the motor 4 according to the torque pattern and the speed pattern is calculated from a motor model.

Then, with this inverter current value set as an input value of the aforementioned temperature model, a predicted temperature of the equipment is calculated. At this moment, inverse Laplace transform of a transfer function is simplified by approximating a current value to a constant value i(t) as described above, so it becomes easy to calculate a time response of the temperature. If a response time segment at this moment is denoted by $T_d$, $T_d$ can be set arbitrarily, but it is necessary to calculate a temperature at least while the inputted value is not zero. When there is a time lag in the temperature model or when the temperature model has a large time constant, the temperature may rise even after the inputted value became zero. Thus, $T_d$ is set long.

In calculating a temperature value using the equation 4, an initial value x(0) is zero when the elevator is run for the first time. However, when the elevator is run for the second time or thenceforth, $x(T_d)$, which is obtained through a calculation at the time when the elevator is run last time, substitutes for the initial value x(0). $T_b$ is also zero when the elevator is run for the first time. However, when the elevator is run for the second time or thenceforth, $T(T_d)$, which is obtained through a calculation at the time when the elevator is run last time, substitutes for $T_b$. $T_0-T_d$ is a correction term of the temperature, and serves to absorb a difference between a predicted temperature value calculated according to the temperature model and an actual temperature. In other words, a temperature state can be more accurately estimated by using an output of the thermal sensing device.

In a step ST25, it is determined whether or not the predicted temperature of the equipment calculated in the step ST24 is within a preset allowable range. This determination is made according to whether a maximum value, an effective value, an average, or $T(T_d)$ in the time response segment ($0 \leqq t \leqq T_d$) calculated in the aforementioned step ST22 falls within the allowable range. An upper-limit value and a lower-limit value are set for the allowable range. If it is determined that the predicted temperature falls within the allowable range, the elevator is started to be run at a set acceleration or deceleration, a set maximum speed, and a set jerk. If it is determined that the predicted temperature goes out of the allowable range, the process proceeds to a processing in a step ST26. The upper-limit temperature value, which is set to a temperature at which generated heat does not make the equipment inoperable, prevents the elevator from becoming unable to be run. The lower-limit value is set to prevent the running efficiency of the elevator from being reduced excessively. In consideration of the fact that a maximum acceleration or deceleration, a maximum jerk, and a maximum jerk are set among settable values, and in the case where a temperature calculation result indicates the lower-limit value or less, the running of the elevator may be started at the set acceleration or deceleration, the set maximum speed, and the set jerk in a step ST27, instead of shifting the processing to the step ST26.

In the step ST26, an acceleration or deceleration value, a maximum speed value, and a jerk value are set again. In general, when the elevator is run at a high speed, a high acceleration or deceleration, and a high jerk, a large current value tends to cause a great temperature rise. Therefore, when the upper-limit temperature value is exceeded, the acceleration or deceleration, the jerk, and the maximum speed are set again to a set of values smaller than those set last time. Further, the lower-limit value is set, and when the temperature is below the lower-limit value, the acceleration or deceleration, the jerk, and the maximum speed are set again to a set of values larger than those set last time. After that, the process returns to the processing in ST24.

For instance, when there are two combinations S1 and S2 of an acceleration or deceleration, a jerk, and a speed, the magnitudes of S1=($\alpha$1, $\beta$1, v1) and S2=($\alpha$2, $\beta$2, v2) may be compared with each other by ranking them with regard to the magnitudes of the accelerations or decelerations $\alpha$1 and $\alpha$2, the jerks $\beta$1 and $\beta$2, or the maximum speeds v1 and v2, or by defining functions composed of the respective values and comparing the magnitudes of the functions with each other. Alternatively, their magnitudes may be compared with each other by calculating time averages of input amounts inputted to the equipment that generates speed patterns calculated for S1 and S2 and comparing the calculated time averages with each other.

Although the foregoing description shows an example in which the acceleration or deceleration value (acceleration, deceleration) and the jerk value (from activation to acceleration, from acceleration to speed constancy, from speed constancy to deceleration, and from deceleration to stoppage) remain unchanged, they may be changed.

Although this embodiment deals with an example in which the thermal sensing device 3 is installed in the power drive unit 2 to prevent the power drive unit 2 from being overloaded, it goes without saying that the hoisting machine 5 can be prevented from being overloaded if the thermal sensing device 3 is installed in the hoisting machine 5 and the present invention is applied thereto.

As described above, according to this embodiment, a total amount of the temperature rise in the end can be accurately predicted irrespective of the value of a thermal time constant by calculating a predicted temperature of the equipment by means of the temperature model, and an operation control is performed such that the temperature does not exceed its upper-limit value. Therefore, it can avoid a situation in which the elevator is stopped because of a thermally overloaded operation. Moreover, by providing a lower limit as an allowable temperature value, the operation control of the elevator is performed so as to change over to an operation at a high speed, a high acceleration or deceleration, and a high jerk when the current temperature of the equipment has enough leeway to reach the limit, thereby enhancing the running efficiency.

Embodiment 2

In this embodiment, a data table 10 as shown in FIG. 4 as an example is stored in the main control unit 1. Other constructional details of the embodiment 2 are identical with those shown in FIG. 1, so the description thereof is omitted herein, and FIG. 1 is simply referred to. The data table 10 has a data table whose inputs include a load within the car 6, a moving distance of the car 6, and a speed pattern of the car 6 (an acceleration or deceleration, a maximum speed, and a jerk of the car 6), and whose outputs include a moving time of the car 6 for the speed pattern and a drive input amount for driving the power drive unit 2. This data table 10 is divided into p tables depending on the moving distance of the car 6. The number p is determined according to a distance by which the car can move (the number of floors). The data table 10 corresponding to a moving distance Lk ($1 \leqq k \leqq p$) further outputs a moving time $Wij_{13}$ k of the car 6 and a drive input amount Uij_k inputted to the equipment for a car load Hi ($1 \leqq i \leqq N$) and a speed pattern (aj_k, βj_k, vj_k), ($1 \leqq j \leqq M$). There are N combinations of the car load. This number N is set to a suitable value, such as, for example, the prescribed number of passengers, through a suitable division depending on an adoptable load. Using an acceleration or deceleration αj_k, a jerk βj_k, and a maximum speed vj_k of the car 6 as elements, the speed pattern is set as a plurality of modes such as a high speed mode ($\alpha 1_k$, $\beta 1_{13}$ k, $v1_{13}$ k), a medium speed mode ($\alpha 2_{13}$ k, β2_k, v3_k), and a low speed mode (α3_k, β_k, v_k).

The moving time Wij_k of the car as an output value can be calculated from a car load, a speed pattern, and a moving distance. The drive input amount Uij_k inputted to the equipment can also be calculated as described in the embodiment 1. Through these calculations, the aforementioned data table 10 can be tabulated in advance.

The operation procedure of this embodiment will now be described using FIG. 5. Each block where the same processing as in the embodiment 1 is performed is denoted by the same reference symbol as in FIG. 2 and the description thereof will be omitted.

Figure 2:
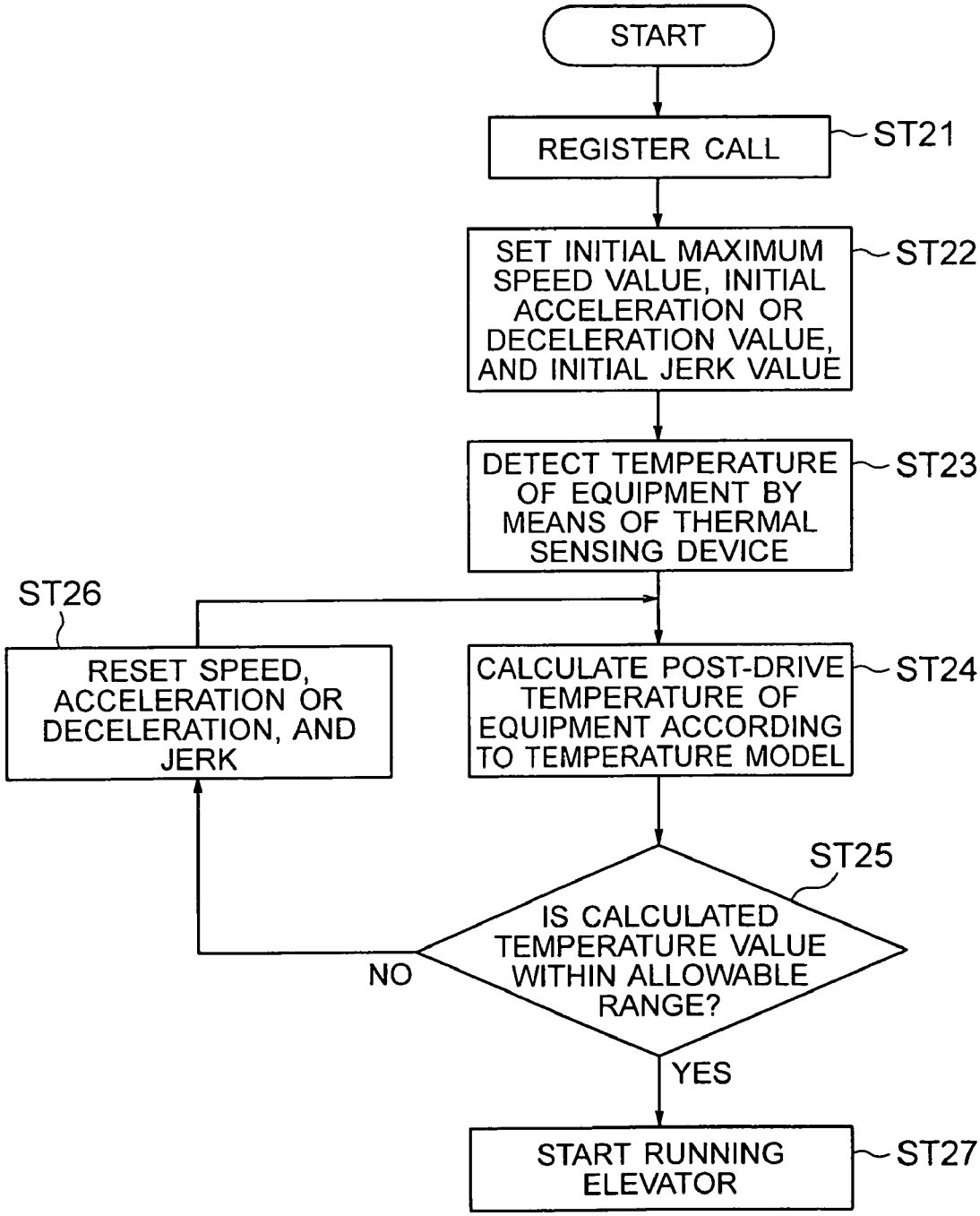
FIG. 2 is a flowchart showing a speed pattern selecting procedure in the elevator controller according to the embodiment 1 of the present invention.
Figure 5:
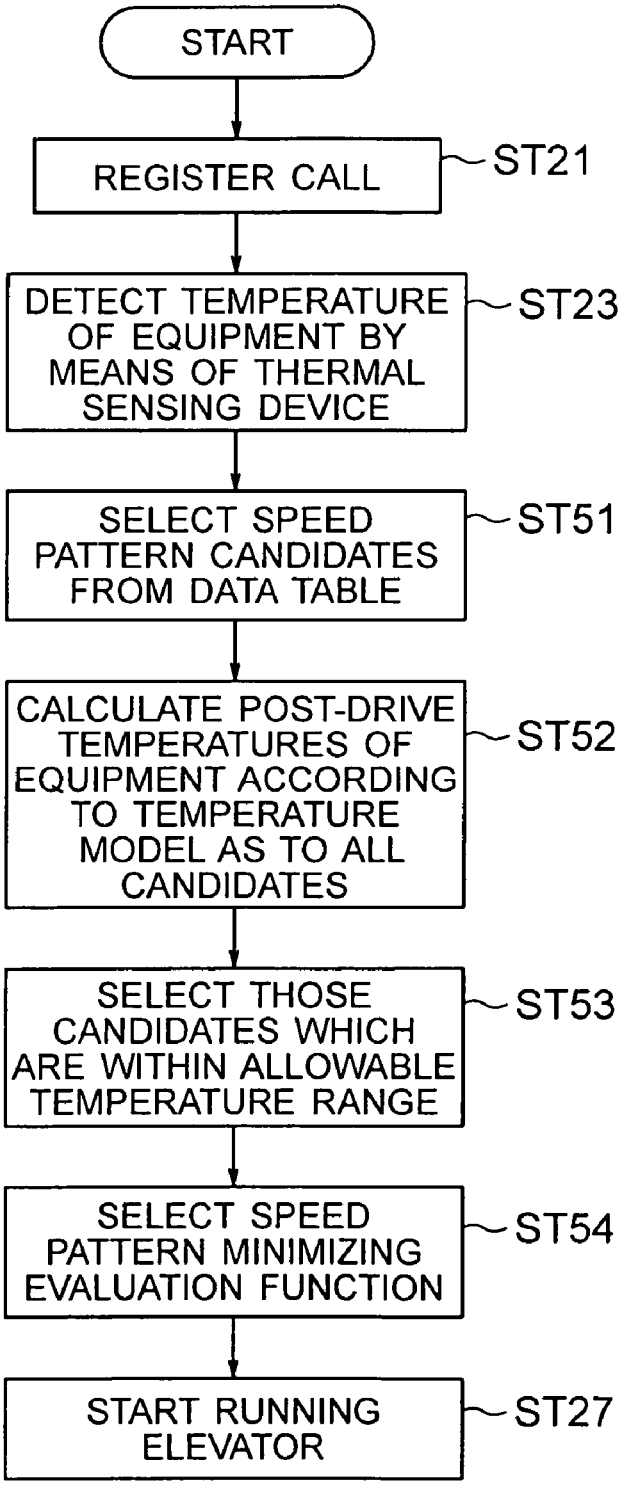
FIG. 5 is a flowchart showing a speed pattern selecting procedure in the elevator controller according to the embodiment 2 of the present invention.

Referring to FIG. 5, in a step ST51 (candidate extracting means), which follows the steps ST21 and ST23 shown in FIG. 2, pairs of a moving time and a drive input amount (Wi1_k, Ui1_k), . . . , (WiM_k, UiM_k) corresponding to all M speed patterns (αi1_k, βi1_k, vi1_k), . . . , (αiM_k, βiM_k, viM_k) are selected as candidates from the table of FIG. 4, for the moving distance Lk and the car load Hi set in the preceding step ST21.

In a step ST52 (predictive calculation means), a predicted temperature value of the equipment is calculated according to the same procedure as in the step ST24 of the embodiment 1, using the drive input amount selected in the preceding step ST51 and the equipment temperature detected in the step ST23. A value in the table may be used as the drive input amount. This calculation is carried out for all the M speed patterns (αi1_k, βi1_k, vi1_k), . . . , (αiM_k, βiM_k, viM_k). It should be noted that Tj represents a predicted temperature calculated for each speed patterns (αij_k, βij_k, vij_k) , ($1 \leqq j \leqq M$).

Here as well, for the same reason as described in the embodiment 1, when a table value of a drive input amount is defined as a time average of an input amount, calculation of a temperature value becomes easy and can be performed by a more inexpensive calculator.

In a step ST53 (allowable range confirming means), as in the step ST25 of the embodiment 1, it is determined whether the temperature value calculated in the preceding step ST52 falls within an allowable range, and the temperature values within the allowable range are selected as candidates. In this embodiment, however, the lower-limit of the allowable range is set to zero, and all the speed patterns at or below the upper limit of the allowable range are selected.

In a step ST54 (speed pattern determining means), the moving times Wij_k corresponding to the respective speed patterns selected in the step ST53 are compared with one another, and a speed pattern corresponding to a minimum one of the moving times Wij_k is selected.

In this embodiment, as described above, a speed pattern corresponding to a minimum moving time within an allowable range of a temperature rise is selected, whereby the running efficiency of the elevator can be enhanced.

The following effect is also obtained in this embodiment. If there are a high-speed speed pattern and a low-speed speed pattern as speed patterns, the low-speed speed pattern is invariably selected in making a changeover to an overload suppressing operation in the conventional arts. This is because a comparison between the low-speed speed pattern and the high-speed speed pattern reveals that the temperature value in the low-speed speed pattern tends to be kept smaller, but at the expense of a long moving time, than that in the high-speed speed pattern. In some cases, however, the moving time is shorter in the high-speed speed pattern, which makes the total drive input amount small, so that the temperature value is kept low as well. This is especially noticeable in a case where the moving distance is long. In the conventional arts, the low-speed speed pattern is selected even in such a case. In the present invention, however, the high-speed speed pattern is selected. Accordingly, the speed patterns can be appropriately changed over from one to the other, and the elevator can be operated while suppressing a temperature rise without decreasing the running efficiency needlessly.

The following can also be adopted in the step ST54.

For the speed patterns selected in the step ST53, a speed pattern that minimizes an evaluation function using a temperature Tj and a moving time Wij_k corresponding to each speed pattern as element is selected. If the evaluation function is defined as Tj for example, a speed pattern minimizing a temperature rise is selected. If the evaluation function is defined as Wij_k, a speed pattern corresponding to the shortest moving time within the allowable range is selected. Further, if the evaluation function is defined as $a \times Wij_k + b \times Tj$ using suitable positive values a and b, a trade-off between a temperature rise amount and a moving time can be achieved by adjusting the values a and b. A speed pattern with a reduced moving time is selected as the value a is increased as compared with the value b, whereas a speed pattern with a reduced temperature rise is selected as the value a is decreased as compared with the value b.

In this manner, a trade-off between a temperature rise amount and a moving time can be achieved, and the equipment can be operated on the safe side without substantially decreasing the running efficiency.

In this embodiment, this evaluation function can be adjusted according to a time zone or a result of the thermal sensing device. For example, the temperature and the running efficiency can be adjusted according to a time zone by adjusting the evaluation function so as to reduce the temperature when a value detected by the thermal sensing device 3 is close to an allowable upper limit, and adjusting the evaluation function so as to reduce the moving time when the current temperature has enough leeway to reach the limit. Alternatively, the evaluation function may be set so as to suppress a temperature rise prior to the morning rush hours, and to enhance the running efficiency during the rush hours. Thus, it is expected to ease congestion and to reduce waiting time.

According to this embodiment, as described above, it is possible to achieve a trade-off between a temperature rise amount and a moving time, and to make an improvement in total running efficiency.

Although the combinations of the car load and the moving distance are set for all their assumable values in the data table 10 shown in FIG. 4 in this embodiment, the number of the combinations may be reduced by integrating, for example, the elements that are close to one another in drive input amount and moving time. Thus, the capacity of the data table is reduced, which leads to reduction in storage capacity of the main control unit 1. In the step S51 in this case, a running pattern closest to the car load and moving distance calculated in the step ST21 is selected.

Although a drive input amount is used to estimate a temperature state in this embodiment, the temperature state can be estimated without using the drive input amount by employing a method such as calculating a temperature rise for a drive input amount in advance, obtaining a temperature rise for the number of starts or the number of passengers through a test or the like conducted with the aid of an actual equipment. Thus, the temperature state can be estimated by a more inexpensive calculator.

Embodiment 3

In this embodiment, the main control unit 1 has statistical data on the number of passengers on (or the number of starts of) the elevator in a predetermined time segment. The data are expressed as, for example, time-series data shown in FIG. 6. Because other constructional details of the embodiment 3 are identical with those shown in FIG. 1, the description thereof is omitted, and FIG. 1 is simply referred to.

Figure 6:
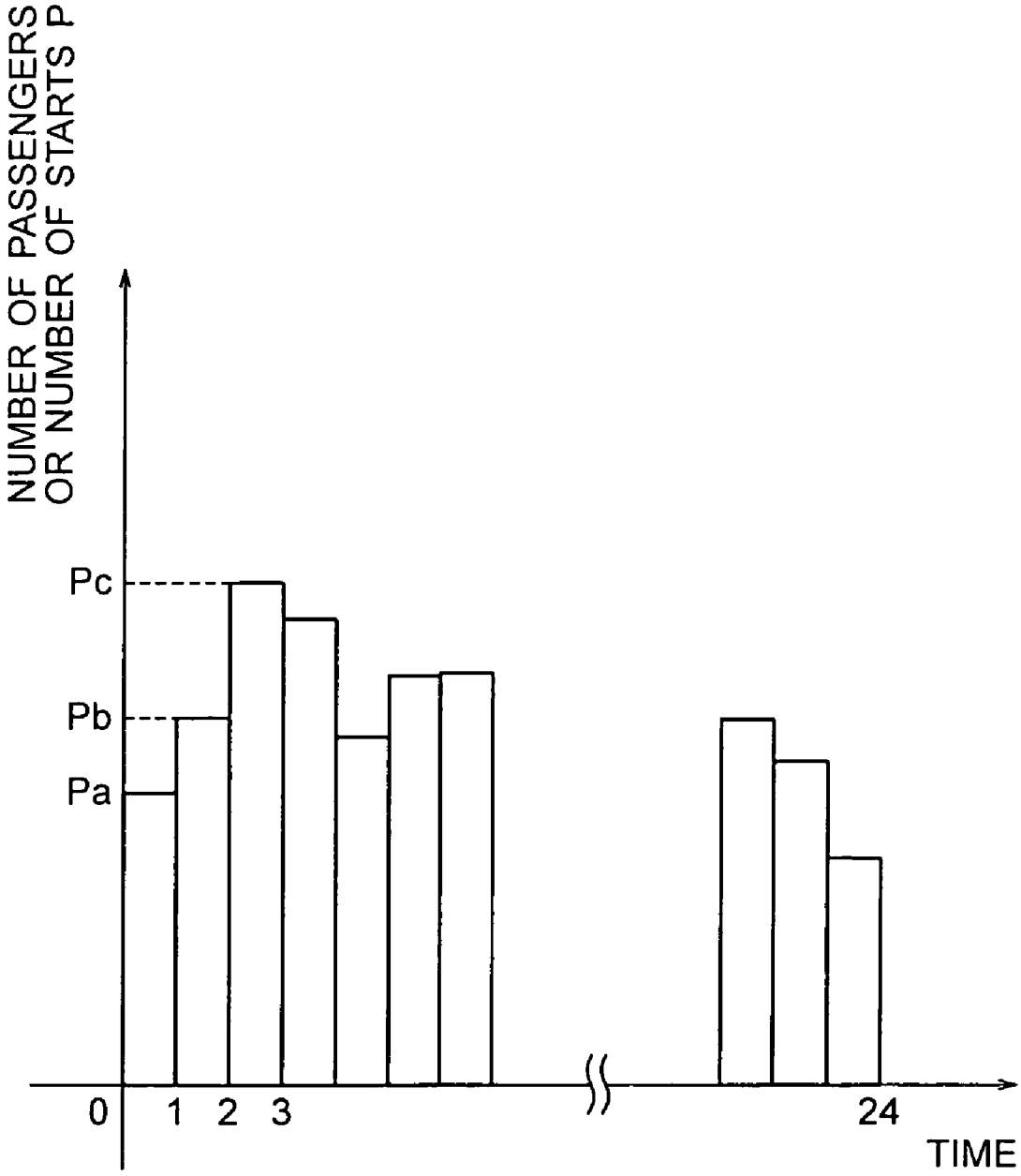
FIG. 6 is an explanatory diagram showing statistical data on the number of passengers or the number of starts in an elevator as a control target of the present invention.

FIG. 6 shows, as statistical data, the number of passengers on (or the number of starts of) the elevator per hour from 0 a.m. on a certain day to 0 a.m. on the following day. Therefore, the time segment is one day, which is an example and is set appropriately. Such statistical data can be created by compiling data on the running of the elevator. Further, since the statistical data often assume a fixed shape in a case of an office building or a condominium building, only two kinds of data, namely, weekend data and weekday data may be provided.

The main control unit 1 has a data table 20 for a plurality of running modes as shown in FIG. 7 (q in FIG. 7 (q is an arbitrary value equal to or larger than 1)). In each of the running modes, a speed pattern (an acceleration or deceleration $\alpha^*$, a jerk $\beta^*$, a maximum speed v* of a car) is set for a moving distance L* of the car and a car load H*. This speed pattern is set such that the performance of the motor 4 can be efficiently used according to the car load and the moving distance. For example, when the car load is balanced with the balance weight 7, a high acceleration or deceleration, a high jerk, and a high maximum speed are set. Where the moving distance is long, the maximum speed of the car is set to a large value. Where the moving distance is short, the acceleration or deceleration is set to a large value. Hereinafter, "*" represents a suitable suffix. A running mode is set according to the transport capacity of the elevator. For example, a high maximum speed, a high acceleration or deceleration, and a high jerk are set in a running mode 1, a medium maximum speed, a medium acceleration or deceleration, and a medium jerk each standing at 80% of a corresponding value in the running mode 1 are set in a running mode 2, and a low maximum speed, a low acceleration or deceleration, and a low jerk each standing at 60% of a corresponding value in the running mode 1 are set in a running mode 3.

A data table 30 as shown in FIG. 8 contains data on an average travel time (or an average waiting time) w* and an average drive input amount Q* inputted to the equipment, which depend on a running mode and the number P* of passengers on (or the number of starts of) the elevator per unit time. The waiting time ranges from a time point when a passenger calls the elevator to a time point when the passenger boards the car 6. The travel time ranges from a time point when a passenger calls the elevator to a time point when the passenger arrives at a destination floor. The average waiting time and the average travel time are average values calculated from each of the waiting time and the travel time per passenger. The average drive input amount Q* is an average of a total input amount per unit time. It can be assumed without losing generality that P1<P2<P3< . . . <Pn. The aforementioned data table 30 can be calculated from an actual running record of the elevator, an incidence model (mathematical expression model) of passengers, and the like, by means of a calculator simulation or the like. As a rule, a high acceleration or deceleration, a high jerk, and a high maximum speed lead to a short average travel time and a short average waiting time, but to a large drive input amount inputted to the equipment. Further, the number of starts of the elevator generally increases as the number of passengers increases, so the drive input amount inputted to the equipment increases. Also, a large average drive input amount causes a large load applied to the equipment and thus a temperature rise amount becomes large. The present invention provides an elevator system that selects a running mode in which the average waiting time and the average travel time are reduced insofar as the equipment is not overloaded, while ensuring a trade-off between the load amount of the equipment and the waiting time or travel time of passengers.

Figure 9:
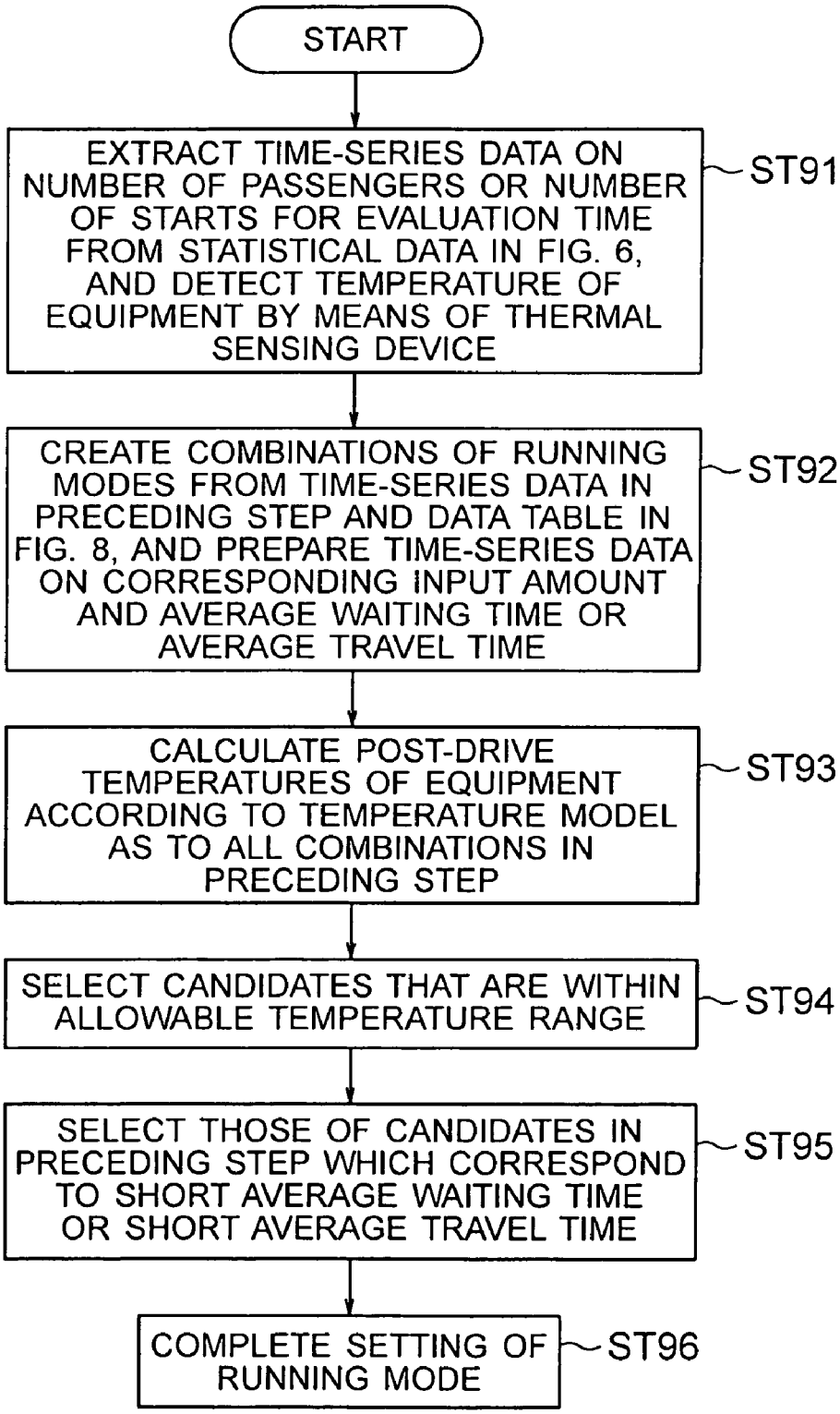
FIG. 9 is a flowchart showing a running mode selecting procedure in the elevator controller according to the embodiment 3 of the present invention.

A method of selecting such a running mode will be described using a flowchart of FIG. 9. The following description will be made as to a case where the statistical data shown in FIG. 6 are used.

First of all, in a step ST91 (running result input means), a suitable time is selected from a time zone including a current time $t_0$ and set as an evaluation time segment, and the numbers of passengers (or the numbers of starts) during that evaluation time segment are arranged in a time-series manner. For instance, a current time of 0:00 and an evaluation time segment of three hours result in (Pa, Pb, Pc). Then, the thermal sensing device 3 detects a temperature of the equipment.

Then in a step ST92 (candidate extracting means), all combinations of running modes adoptable in FIG. 8 are listed in a manner corresponding to the aforementioned time-series data. In the case of disagreement of numerical values, a closest value is selected. Considering a case where there are three running modes (q=3) as an example, three running modes can be adopted for Pa, Pb, and Pc respectively. Therefore, there are nine combinations in total. Then, time-series data on the drive input amount Q* and the average waiting time (or average travel time) w* corresponding to each of the combinations of the running modes are created.

Then in a step ST93 (predictive calculation means), out of the combinations listed in the aforementioned step ST92, a temperature state of the equipment is calculated from the time-series data corresponding to the drive input amount. This calculation is carried out according to a method similar to that of the step ST24 described in the embodiment 1.

In a step ST94 (allowable range confirming means), all combinations of running modes in which the temperature state calculated in the aforementioned step ST93 falls within the allowable range are selected as candidates. This selection is made according to a method similar to that of the step ST53 in the embodiment 2.

In a step ST95 (running mode determining means), of the above-mentioned candidates, the one having the minimum average waiting time (or average travel time) of passengers is determined as a running mode. This determination is made as follows. Given that m candidates are selected in the step ST94 and that time-series data on the average waiting time (or average travel time) corresponding to the respective candidates are denoted by {wa1, wb1, wc1}, . . . , {wam, wbm, wcm}, a minimum one of values Jk ($1 \leqq k \leqq m$) calculated according to the following equation 5 shown below is determined as a running mode.

$$Jk=(Pa*wak+Pb*wbk+Pc*wck)/(Pa+Pb+Pc),\ 1 \leqq k \leqq m \qquad \text{Equation 5}$$

The setting of the running mode is thus completed (step ST96)

In this manner, a running mode is periodically set according to the aforementioned respective steps. Although a time interval for the setting of the running mode can be arbitrarily set, the accuracy in estimating a temperature increases as the time interval decreases. However, the time interval should not be set too short because otherwise an increase in calculated amount would be caused. For instance, the setting is carried out every hour.

After the running mode is set and a passenger makes a call for the elevator, a car speed, an acceleration or deceleration, and a jerk are selected from correlation tables in FIG. 7 according to a car load and a moving distance, and the elevator is operated.

In the statistical data as shown in FIG. 6, a reduction in unit time and an increase in evaluation time segment make it possible to finely estimate changes in temperature state, so that a more efficient running mode is selected in consideration of a forthcoming temperature state and a forthcoming number of passengers. However, an excessive reduction in unit time or an excessive increase in evaluation time segment causes an increase in calculated amount, so they are determined in consideration of a trade-off therebetween.

In this embodiment, as described above, running patterns are appropriately changed over from one to another according to a time zone such that the average waiting time or average travel time of passengers decreases while the temperature of the equipment is within an allowable range, in accordance with the statistical data on the number of passengers on the elevator or the frequency of start-up of the elevator. Thus, the elevator can be run at a high running efficiency without exceeding a temperature limit permitting a componential equipment to be driven.

In a case where the number of passengers per day is fixed to some extent according to a time zone, for example, in an office building or a condominium building, statistical data are subject only to minor variations, so a great effect is achieved. In a time zone in which there are many passengers, for example, during morning and evening rush hours, a running mode with a reduced waiting time is selected, which may reduce the passengers' irritation. Further, since a running pattern is selected so as to reduce the waiting time or the travel time in a time segment for evaluation, and thus the running efficiency is enhanced as a whole.

In the embodiments 1 to 3 of the present invention, a temperature state is estimated using a drive input amount of a predetermined componential equipment. However, the temperature state can also be estimated using a temperature rise amount of the predetermined componential equipment instead of the drive input amount, by employing a method such as calculating a temperature rise amount in the predetermined componential equipment for a drive input amount in advance, obtaining a temperature rise amount in the predetermined componential equipment for the number of starts or the number of passengers through a test or the like conducted with the aid of an actual equipment, or the like. In describing this case, the drive input amount in the foregoing description is replaced with the temperature rise amount. Thus, an estimation of the temperature state can be realized through calculation by a more inexpensive calculator.

Figure 10:
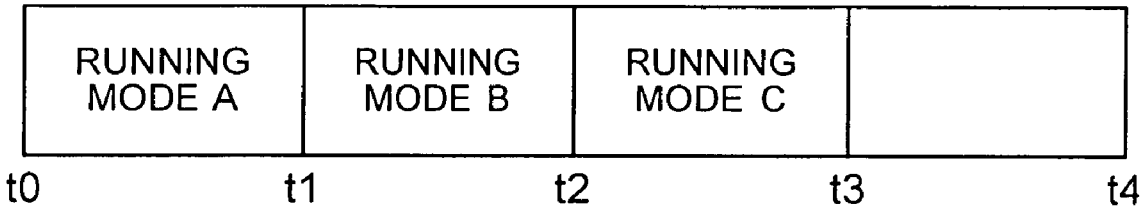
FIG. 10 is an explanatory diagram showing a method for reducing a calculated amount in renewing a running mode in the elevator controller according to the embodiment 3 of the present invention.

In the following case, the calculation amount in renewing the running mode can be reduced. An example thereof will be described using FIG. 10. Referring to FIG. 10, it is assumed that a running mode is set at a time t0. The evaluation time segment in this case is set as three units, and running modes A, B, and C are set in respective time units that are segmented by the time t0 and times t1, t2, and t3 according to the method of this embodiment. If the segment for renewing the running mode is set as one unit, the operation of renewal is performed at the time t1, and running modes for time segments t1-t2, t2-t3, and t3-t4 are set. In this method, at this moment, the running modes selected at the time of last renewal in the step ST92, namely, the running mode B between the times t1-t2 and the running mode C between the times t2-t3 are not changed, and only a running mode that can be adopted between the times t3-t4 is extracted from adoptable combinations, whereby time-series data are created.

This is because the running modes selected at the time of last renewal, namely, the running mode B between the times t1-t2 and the running mode C between the times t2-t3 are selected so as to reduce the waiting time or the moving time while complying with an allowable temperature range, and thus are likely to be selected even if a selection is made at the time of the current renewal without employing this method. This method makes it possible to reduce the number of combinations of time-series data, which is reduced from nine to three in this example.

When the temperature state calculated from these candidates is out of the allowable range, it is appropriate to return to the step ST92 and create a candidate by changing the running mode B between the times t1~t2 and the running mode C between the times t2~t3.

When the evaluation time segment in creating time-series data on the running mode is longer than the renewal time for setting the running mode again as in this case, the time required for calculation can be shortened by setting only combinations corresponding to newly added time period as candidates in setting the running mode again.

The invention claimed is:

1. An elevator controller comprising:

a main control unit for controlling running of an elevator, wherein the main control unit calculates a plurality of first elevator travel parameters for an operation of the elevator, calculates a future predicted temperature state of a predetermined component of the elevator, compares the predicted temperature state to a range of permitted temperature states, performs operational control of the elevator using the first elevator travel parameters if the predicted temperature state is within the range, and changes at least one of the plurality of first elevator travel parameters if the predicted temperature state is outside of the range to obtain second travel parameters that will maintain a temperature of the component within the range and performs operation control of the elevator using the second elevator travel parameters.

2. The elevator controller according to claim 1, further comprising:

a thermal sensing device that detects a temperature of the component; and change amount input means for inputting a predetermined change amount concerning the component, wherein the main control unit calculates a predicted value of a temperature state of the component using the temperature detected by the thermal sensing device and the change amount inputted by the change amount input means.

3. The elevator controller according to claim 2, wherein the predetermined change amount is a drive input amount for driving the component.

4. The elevator controller according to claim 3, wherein the component comprises a power drive unit that drives a motor for causing a hoisting machine to rotate in response to a command from the main control unit, and the drive input amount comprises a current value of the power drive unit.

5. The elevator controller according to claim 2, wherein the predetermined change amount comprises a temperature rise amount of the component.

6. The elevator controller according to claim 2, wherein the change amount of the component comprises a time average.

7. The elevator controller according to claim 1, wherein the main control unit calculates the future predicted temperature state of the component based on changes with time in one of statistics, namely, a number of starts of the elevator per unit time and a number of passengers on the elevator per unit time, and performs the operation control of the elevator based on the temperature state such that the component does not become overloaded.

8. The elevator controller according to claim 1, wherein:

the control unit reduces at least one of a plurality of elevator travel parameters if the predicted temperature state exceeds a maximum of the range and increases at least one of the elevator travel parameters if the predicted temperature state is below a minimum of the range.

9. The elevator controller according to claim 8, wherein the elevator travel parameters comprise plural of acceleration, deceleration, jerk, and maximum speed.

10. The elevator controller according to claim 1, wherein:

the control unit determines a plurality of sets of elevator travel parameters based upon comparing the predicted temperature state to the range, selects one of the sets based upon a comparison of one of the elevator travel parameters in the sets, and controls operation of the elevator based upon the one set of elevator travel parameters.

11. The elevator controller according to claim 10, wherein the elevator travel parameters comprise plural of acceleration, deceleration, jerk, and maximum speed.

12. A method of operating an elevator operating system, comprising:

using a temperature sensor to sense a temperature of a component of a drive system of the elevator;

calculating a first elevator travel parameters using the temperature;

calculating a future predicted temperature state of the component of the drive system;

comparing the predicted temperature state to a range of permitted temperature states;

using the first elevator travel parameters if the predicted temperature state is within the range;

changing at least one of a plurality of elevator travel parameters if the predicted temperature state is outside of the range to obtain second elevator travel parameters that will maintain a temperature of the component within the range, and using the second elevator travel parameters if the predicted temperature state is outside of the range.

13. The method according to claim 12, comprising:

reducing at least one of a plurality of elevator travel parameters if the predicted temperature state exceeds a maximum of the range; and increasing at least one of the elevator travel parameters if the predicted temperature state is below a minimum of the range.

14. The method according to claim 12, comprising:

determining a plurality of sets of elevator travel parameters based upon comparing the predicted temperature to the range;

selecting one of the sets based upon a comparison of one of the elevator travel parameters in the sets; and controlling operation of the elevator based upon the one set of elevator travel parameters.

* * * * *